United States Patent [19]

Lacaze, Jr.

[11] 4,239,315

[45] Dec. 16, 1980

[54] ELECTRICAL CONNECTOR

[75] Inventor: Leonard Lacaze, Jr., San Juan Capistrano, Calif.

[73] Assignee: International Telephone and Telegraph Corporation, New York, N.Y.

[21] Appl. No.: 970,276

[22] Filed: Dec. 18, 1978

[51] Int. Cl.[3] ..... H01R 13/639

[52] U.S. Cl. ..... 339/89 M; 339/91 B; 339/113 R

[58] Field of Search ..... 339/89, 91 B, 113 R; 285/87, 88

[56] References Cited

U.S. PATENT DOCUMENTS

| | | | |
|---|---|---|---|
| 2,636,068 | 4/1953 | Perkins | 339/89 |
| 3,601,764 | 8/1971 | Cameron | 285/88 X |
| 3,869,186 | 3/1975 | Vetter | 339/89 R |
| 3,901,574 | 8/1975 | Paullus et al. | 339/113 R X |

*Primary Examiner*—Richard B. Lazarus
*Assistant Examiner*—Eugene F. Desmond
*Attorney, Agent, or Firm*—Thomas L. Peterson

[57] ABSTRACT

An electrical connector including a telescoping barrel and shell arrangement with a coupling nut to draw them together so that a shell end surface abuts a shoulder on the barrel. Spring biased detents on the coupling nut engage corresponding cams on the shell to hold the shell tightly and securely against the shoulder. Contact and other wear due to vibration is thus minimized or eliminated.

10 Claims, 22 Drawing Figures

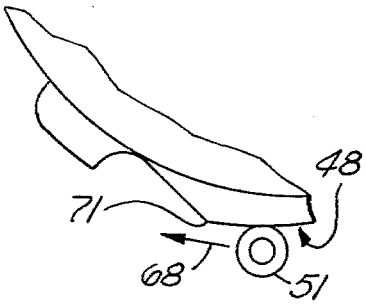
FIG. 12
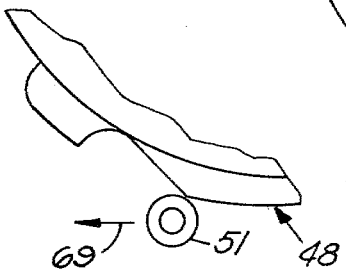
FIG. 13
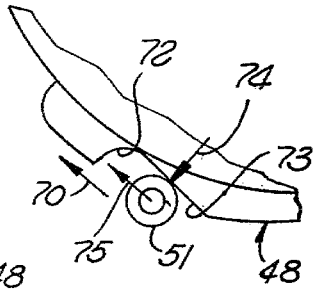
FIG. 14
FIG. 15
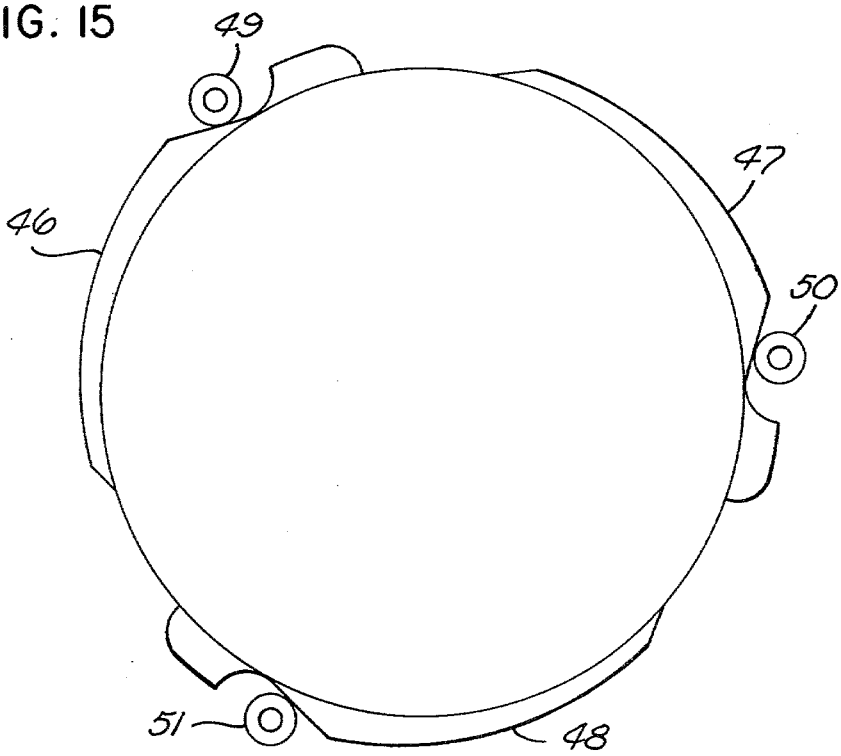

ELECTRICAL CONNECTOR

BACKGROUND OF THE INVENTION

This invention relates to connectors, and more particularly to wear-resistant electrical connectors.

PRIOR ART STATEMENT

Perkins, U.S. Pat. No. 2,636,068

Perkins discloses slugs 11 and snap rings 17.

Cameron, U.S. Pat. No. 3,601,764

Cameron discloses detent teeth 41 and a fixed wear pin 47; however, teeth 41 do not bear entirely upon the inclined portions of the grooves or serrations of flange 42 (column 2, lines 61–63). See also column 2, lines 39–41.

Vetter, U.S. Pat. No. 3,869,186

Coupling nut 66.

Paullus et al., U.S. Pat. No. 3,901,574

See helices 30, 32 and lugs 72 and 74. See also keys 60, etc., and keyways 19, etc. Further, see bosses 40 and 42 in FIGS. 5 and 6.

It is substantially disadvantageous to use an electrical connector in a manner such that it is subjected to vibration of a substantial amplitude (see Cameron). One reason this is true is that the plug and receptacle cannot be fixed securely together and the pins and sockets move relative to each other and wear rapidly to an intolerable degree.

Plugs and receptacles have been employed in the prior art with abutting surfaces biased together by an axially disposed spring. These constructions have been employed to overcome the wear problems caused by vibration; however, they have not been successful. The plugs and receptacles have not been held together securely.

SUMMARY OF THE INVENTION

In accordance with the connector of the present invention, the above-described and other disadvantages of the prior art are overcome by providing an electrical connector with a telescoping barrel and shell in which a coupling nut rotatable in a fixed axial position around the shell has one, two, three or more spring biased detents to engage corresponding arcuate cams fixed relative to the shell, each cam having two intersecting surfaces inclined in opposite directions.

BRIEF DESCRIPTION OF THE DRAWINGS

In the accompanying drawings which illustrate exemplary embodiments of the present invention:

FIGS. 12, 13 and 14 are diagrammatic views of a detent and cam which illustrate locking of the barrel and coupling nut;

FIG. 15 is a diagrammatic view showing three detents and three cams in the locked position;

DESCRIPTION OF THE PREFERRED EMBODIMENT

Figure 1:
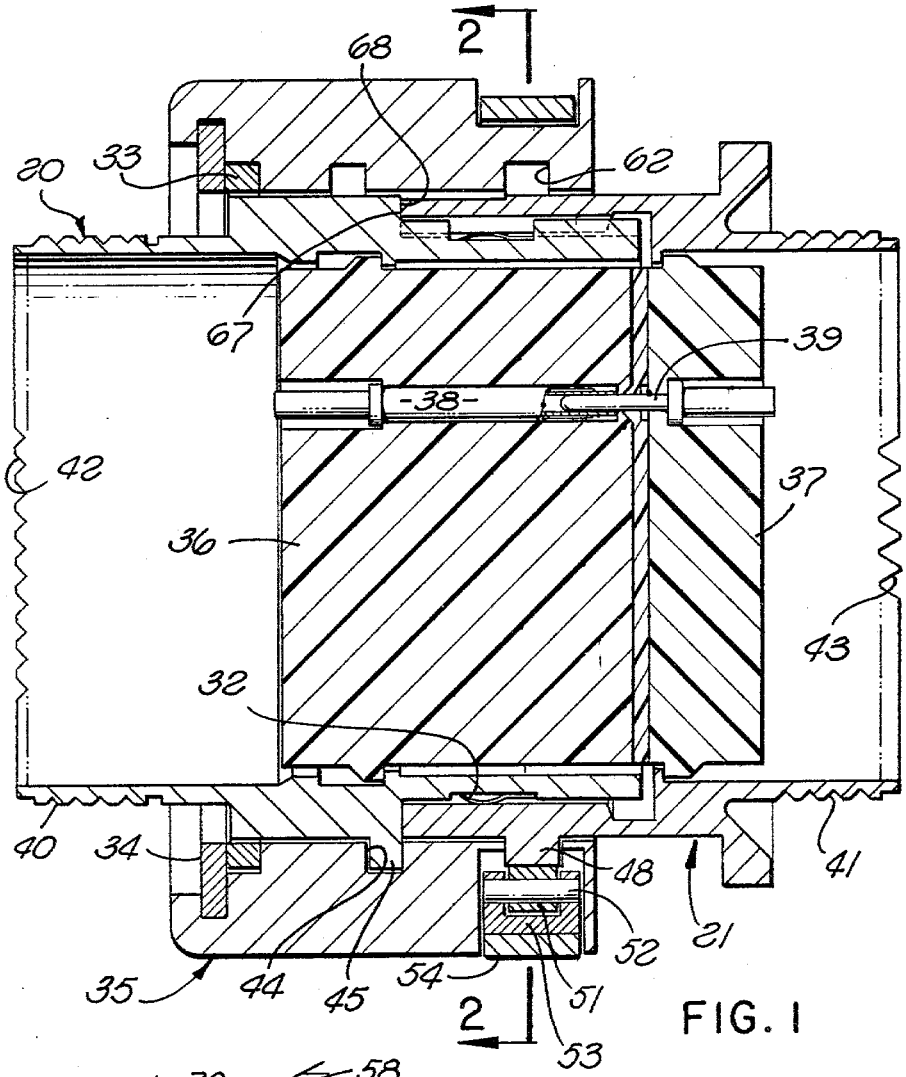
FIG. 1 is a longitudinal sectional of an electrical connector constructed in accordance with the present invention.
Figure 2:
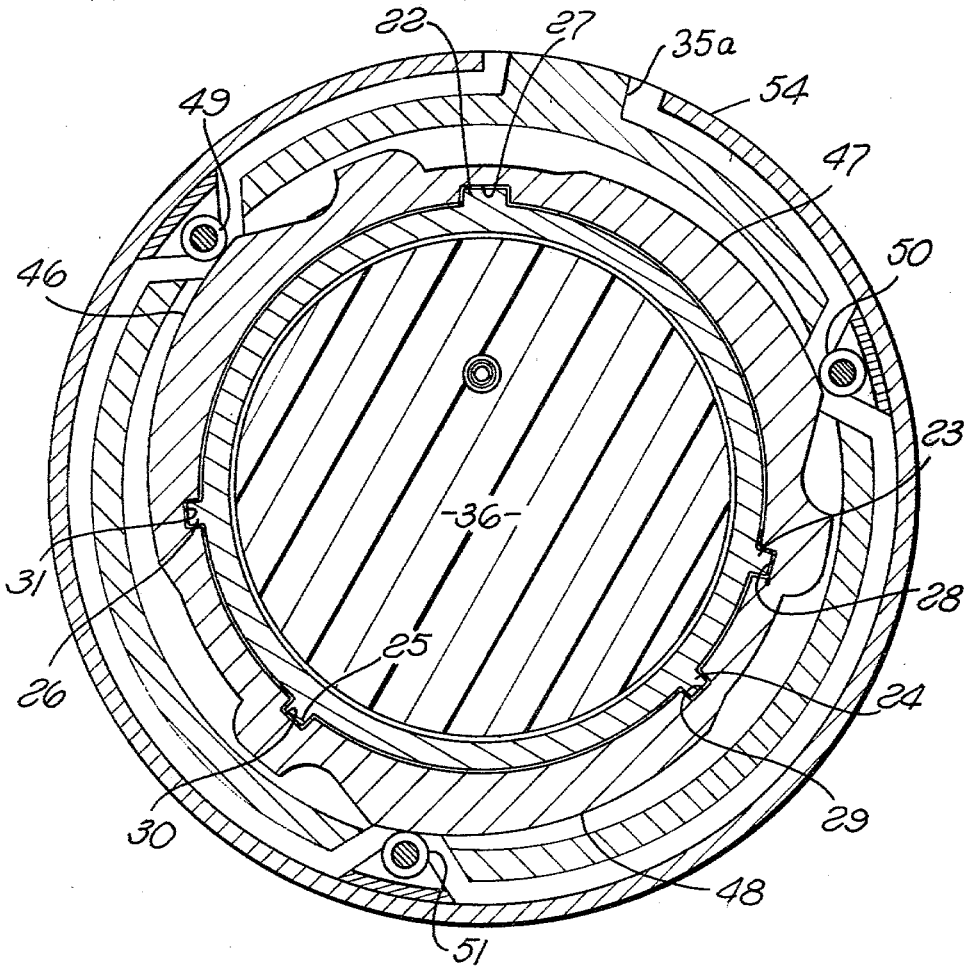
FIG. 2 is a transverse sectional view of the connector taken on the line 2—2 shown in FIG. 1.

The connector of the present invention is illustrated in FIG. 1 including a plug barrel 20 which is guided within a receptacle shell 21. For that purpose, barrel 20 has keys 22, 23, 24, 25 and 26 which are slidable in shell key ways 27, 28, 29, 30 and 31, respectively, all of which are shown in FIG. 2.

In FIG. 1, a conventional grounding spring is provided at 32 fixed relative to barrel 20.

A coupling nut 35 has three helical grooves (cam surfaces) internal thereof to be described. The ends of these grooves are closed by a bushing 33. The bushing is held in place by a conventional retaining spring or snap ring 34.

Insulators 36 and 37 are cemented inside barrel 20 and shell 21, respectively.

For example only, a socket contact is shown at 38 fixed to insulator 36 and a pin contact 39 is shown fixed relative to insulator 37.

Barrel 20 has an external thread 40 and shell 21 has an external thread 41. Barrel and shell edges are serrated at 42 and 43, respectively.

One of the coupling nut helical grooves may be as indicated at 44 in FIG. 1.

Barrel 20 has three helical external projections, (cam followers) one of which is indicated at 45 in FIG. 1 to fit in groove 44. The helical projections and grooves provide a form of a threaded connection between the coupling nut 35 and the barrel 20.

Shell 21 has three circumferentially spaced cams external 46, 47 and 48 as shown in FIG. 2, which are engaged by three corresponding rollers 49, 50 and 51, respectively. In FIG. 1, roller 51 is rotatable upon a pin 52 which is carried by a bracket 53 pressed radially inwardly by a C-shaped spring 54. See FIGS. 1 and 2. The free ends of the spring 54 are spaced apart. A radial projection **35*a* on nut 35 extends into the space between the ends of the spring 54**. Thus, any rotation of the nut is imparted to the spring.

The details of the structures surrounding rollers 49 and 50 are essentially identical to the rollers surrounding roller 51, and will not be described for that reason.

Figure 3:
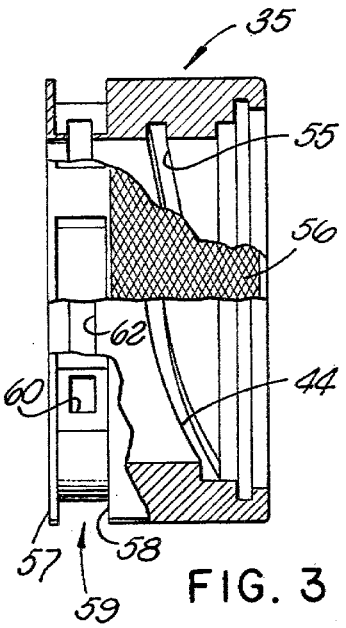
FIG. 3 is a transverse sectional view, partly in elevation, of a coupling nut shown in FIG. 1.

In FIG. 3, coupling nut 34 is shown again having a knurled outside surface portion 56. Two of the three internal helical grooves in coupling nut 35 are shown at 44 and 55.

Coupling nut 35 has a flange 57 and an end face 58 between which a channel 59 is formed. Channel 59 has three rectangular slots 60 through the bottom thereof displaced 120° apart. That is, the slots are equally spaced. The roller-carrying brackets 53 are mounted in the slots 60 and, therefore, rotate with the coupling nut when the nut is rotated on the barrel 20. The rollers 49, 50 and 51 project through the slots and ride upon cams 46, 47 and 48, respectively.

Figure 4:
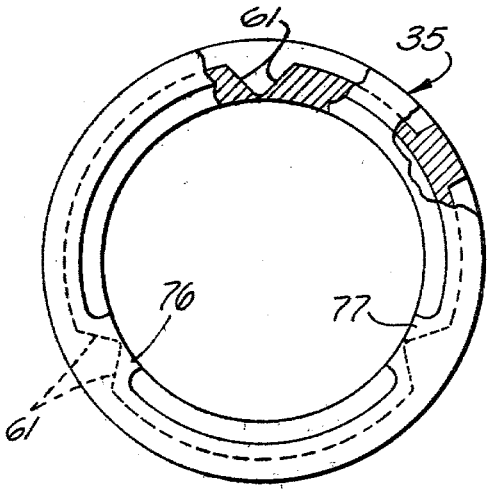
FIG. 4 is a front elevational view, partly in section, of the coupling nut shown in FIG. 3.

The slots 60 are formed through angularly disposed surfaces 61 of coupling nut 35 as shown in FIG. 4. All of the structures shown above spring 54 in FIG. 2 to the top of roller 51 are located within channel 59 shown in FIG. 3.

A recess 62 shown in FIG. 3 corresponds to the same shown in FIG. 1.

Figure 5:
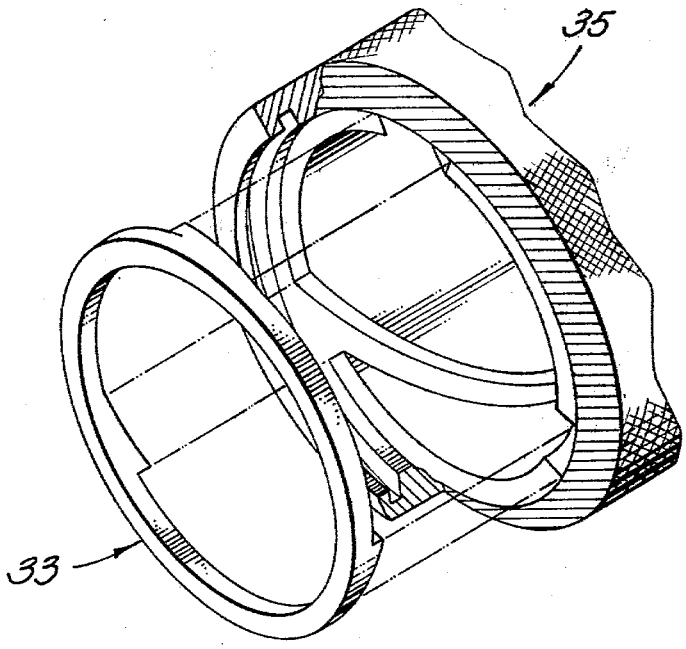
FIG. 5 is an exploded perspective view, partly in section, of the coupling nut shown in FIGS. 3 and 4, and a bushing for assembly with a coupling nut.
Figure 7:
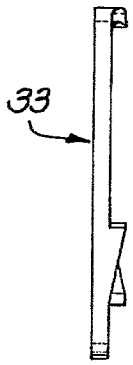
FIG. 7 is a side elevational view of the bushing.
Figure 6:
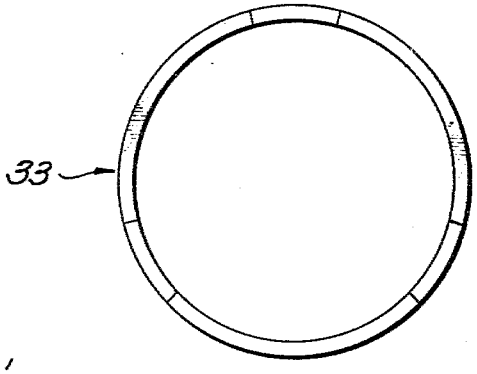
FIG. 6 is a front elevational view of the bushing.

In FIG. 5 bushing 33 is shown with coupling nut 35. The bushing is also shown in FIGS. 6 and 7.

Figure 8:
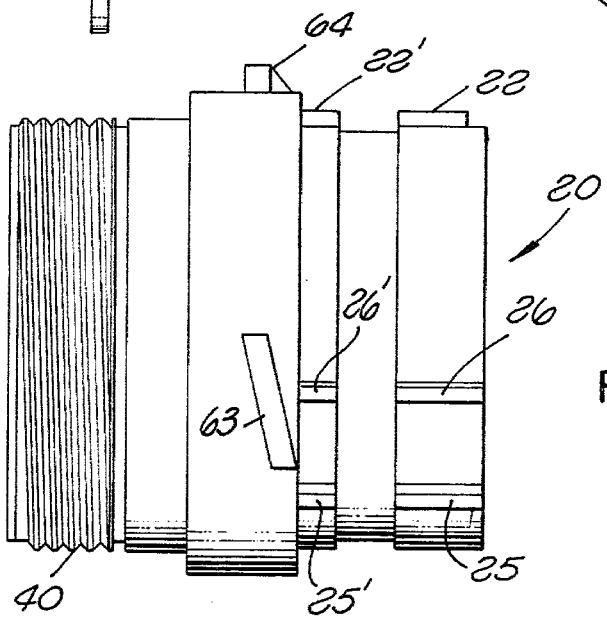
FIG. 8 is a side elevational view of a barrel shown in FIGS. 1 and 2.
Figure 9:
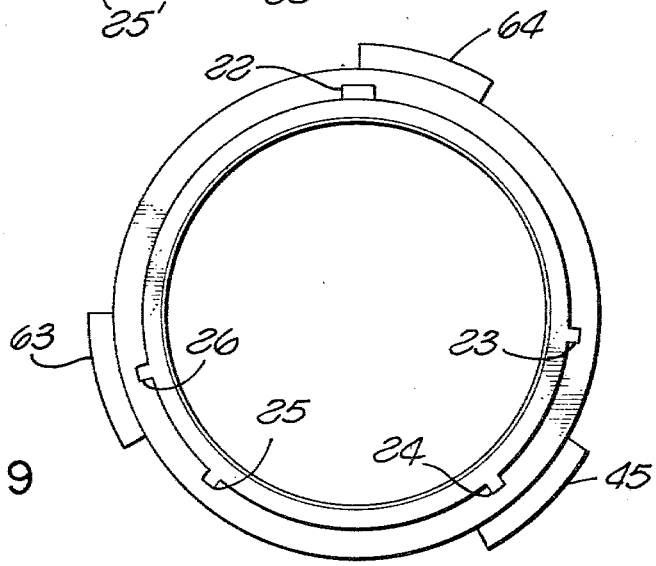
FIG. 9 is a right-end elevational view of the barrel shown in FIG. 8.

Barrel 20 is shown again in FIG. 8.

Projections 63 and 64, and a projection not shown may be disposed 120° apart around an axis of barrel 20, but may otherwise be identical to projection 45 shown in FIG. 1. The helical projections 45, 63, 64 fitted in the helical grooves in coupling nut 35 allow the coupling nut and barrel 20 to move axially relatively to each other when the nut is rotated relative to the barrel.

In FIG. 8, keys 22', 26', 25' and keys corresponding to keys 23 and 24 may be aligned with the keys 22—26.

Figure 10:
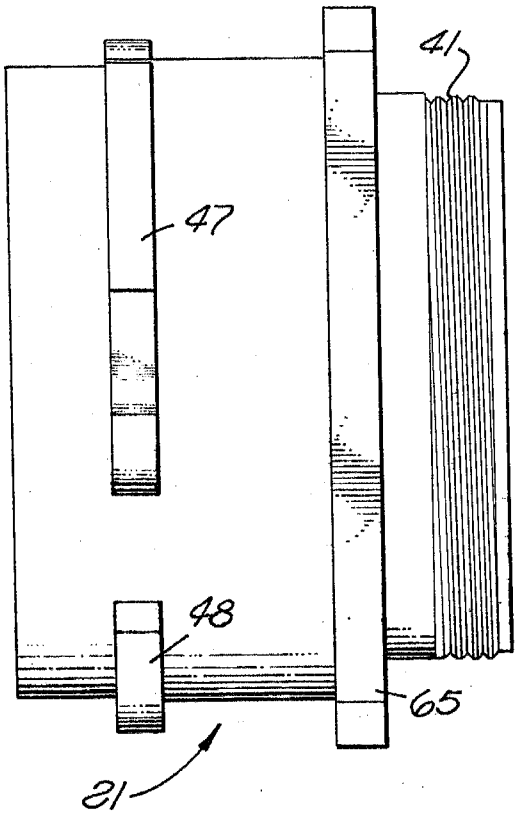
FIG. 10 is a side elevational view of a shell shown in FIGS. 1 and 2.
Figure 11:
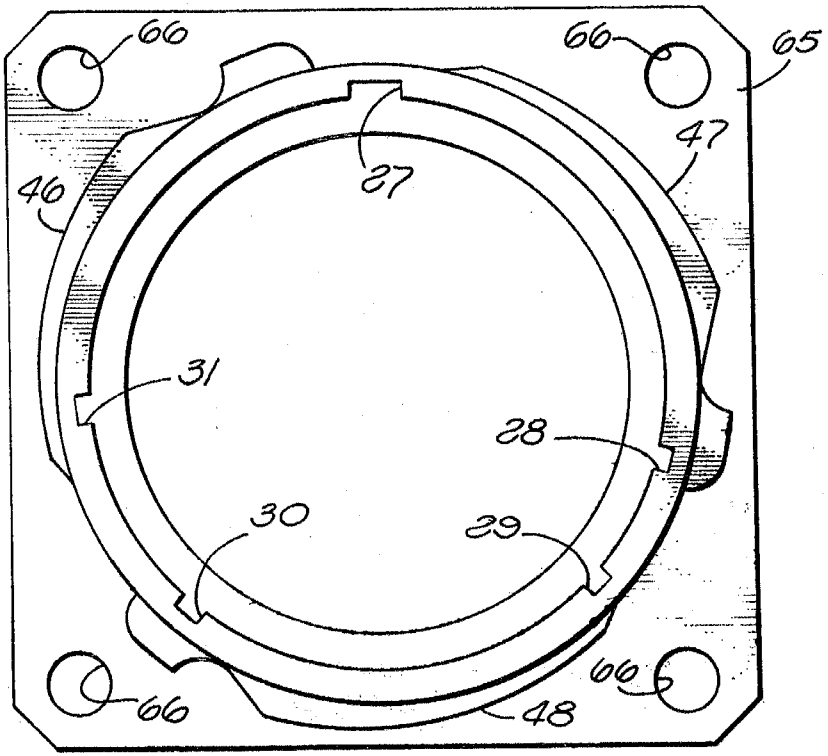
FIG. 11 is a left-end elevational view of the shell shown in FIG. 10.

As shown in FIG. 10, shell 21 has a flange 65. Also shown in FIG. 10, are cams 47 and 48. Shell 21 may be mounted by the use of flange 65 as shown in FIG. 11, flange 65 having mounting holes 66.

One outstanding feature of the present invention is that shell 21 has an annular surface 67 shown in FIG. 1 which abuts a corresponding annular surface 68 of barrel 20 when coupling nut 35 is turned to slide barrel 20 toward shell 21 after the barrel and shell are initially engaged in a manner to be described later.

The connector of the present invention, in accordance with the foregoing, is constructed in a manner such that before surface 67 "bottoms" on surface 68, rotation of the coupling nut 35 in the clockwise direction in FIG. 2 will cause rollers 49, 50 and 51 to ride up corresponding cams 46, 47 and 48, respectively, to the positions shown in FIG. 2 and on past. For example, each roller moves from a position corresponding to that of roller 51 in FIGS. 12, 13 and 14 progressively in a direction of arrows 68, 69 and 70. Cam 48 has an abrupt change in curvature at 71. When roller 51 passes point 71, the locking of the connector can be felt and heard.

The connector is fully mated and locked when the rollers and cams are in the position as shown in FIG. 14. In general, it is not necessary or desirable for roller 51 to roll to a position at the bottom 72 of cam 48. Spring 54 in FIG. 2 thus holds roller 51 on inclined surface 73, and the force upon roller 51 as indicated by an arrow 74 has a component about in a direction indicated at 75 which causes the roller 51 to be kept locked and to be urged in a direction causing the nut 35 to be urged in the clockwise direction in FIG. 2 whereby surfaces 67 and 68 in FIG. 1 are pulled even more tightly together through the camming action of the internal helical groove of the nut with the helical projections 45, 63 and 64.

The positions of all three rollers 49, 50 and 51 relative to cams 46, 47 and 48 when the connector is in a locked position is illustrated in FIG. 15.

Figure 16:
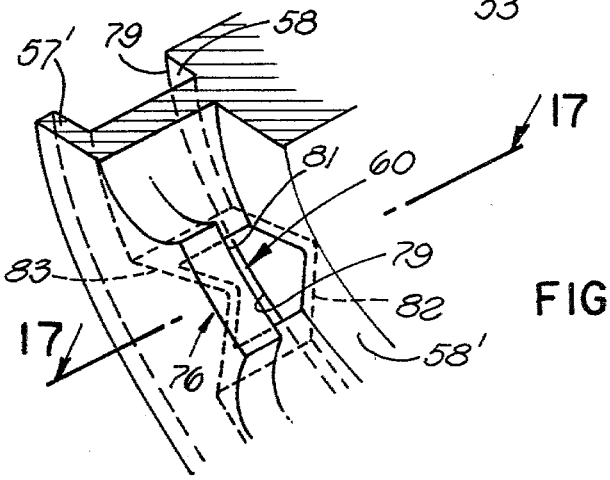
FIG. 16 is an enlarged inside perspective view of the coupling nut, broken away and partly in section.
Figure 17:
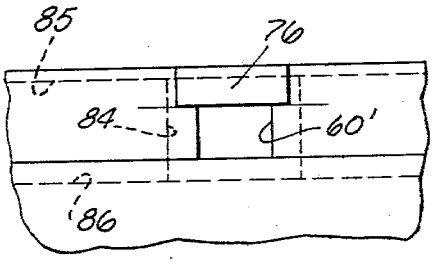
FIG. 17 is a broken away inside radial view of the coupling nut taken on the line 17—17 shown in FIG. 16.
Figure 18:
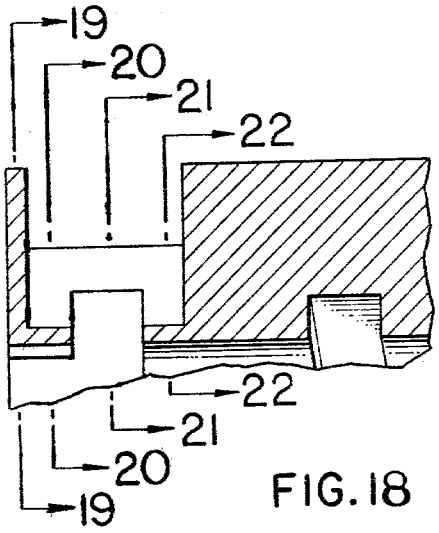
FIG. 18 is an enlarged longitudinal sectional view of the upper portion of the coupling nut shown in FIG. 3.
Figure 19:
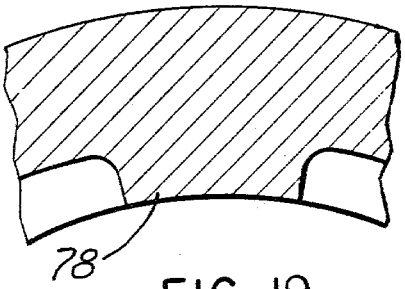
FIG. 19 is a transverse sectional view of the coupling nut taken on the line 19—19 shown in FIG. 18.
Figure 20:
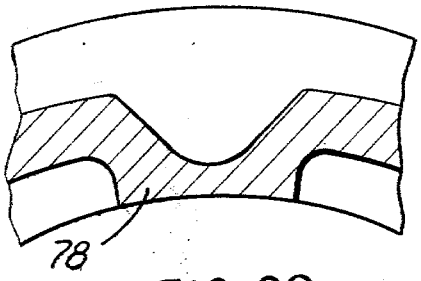
FIG. 20 is a transverse sectional view of the coupling nut taken on the line 20—20 shown in FIG. 18.

Coupling nut 35 has three, circumferentially spaced internal bosses 76, 77 and 78 (see FIGS. 4 and 19). A perspective view of boss 76 is shown in FIG. 16. Coupling nut 35 has a circumferential edge 79. The slot 60 is located behind the boss 76. Slot 60 is located between edge 79 and an edge 81 of boss 76. Face 58' and the boss face through edge 81 parallel thereto are recessed at 82 and 83, respectively, because they are spaced a distance less than outer channel faces 57' and 58. Slot 60 is equal in width to the line 60' in FIG. 17; however, line 84 is longer.

Boss 78 (FIGS. 19–22) has a construction similar to that of boss 76 (FIG. 16).

Figure 21:
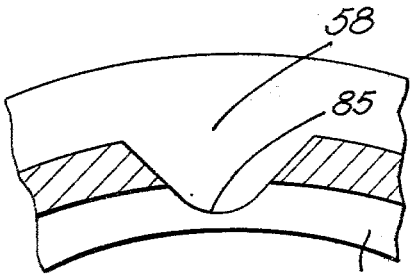
FIG. 21 is a transverse sectional view of the coupling nut taken on the line 21—21 shown in FIG. 18.
Figure 22:
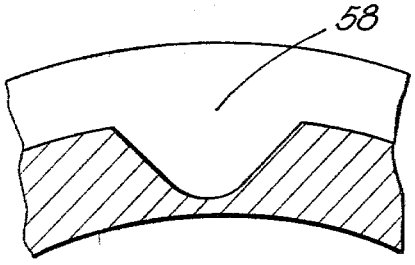
FIG. 22 is a transverse sectional view of the coupling nut taken on the line 22—22 shown in FIG. 18.

The plane of surface 58 is different from that of surface 84 (see line 85 in FIG. 21).

It will be obvious to a person ordinarily skilled in the art to which the present invention pertains that one or more socket contacts may be located in insulator 37, and corresponding pin contacts may be located in insulator 36 in FIG. 1. Still further, a mixture of socket and pin contacts may be provided in one insulator and a corresponding mix in the other.

In the design of certain special electrical connectors, several characteristics are desired to overcome objectionable traits of standard connector types. In particular, a circular connector employing a knurled sleeve has been provided in the prior art which has characteristics as follows:

(1) Turning the knurled sleeve causes the connector to be mated. A mechanism reduces the force encountered in mating the contacts, in contrast to a standard connector, which must be pushed together against high forces.

(2) The connector shells are driven to complete metal-to-metal "bottoming" overcoming elastomeric seals and metal grounding springs. If this positive clamping were not available, the thrust springs that are usually used in standard connectors to absorb tolerance variations would deflect under adverse conditions possibly resulting in worn pin contacts and electrical disturbances.

(3) A distinctive snapping sound is desirable to signal the completion of coupling the connector because a partially engaged connector is unreliable.

(4) A tactile indication of completion of coupling is also desirable because high ambient noise levels may mask the audible indicator.

The operation of the connector of the present invention and the advantages thereof will be appreciated from the following. First the barrel 20 and shell 21 of the plug and receptacle are oriented so that the mating keys and keyways thereon are aligned and the coupling nut is positioned so that the bosses 76, 77 and 78 thereon are aligned with the spaces between the radial cams 46, 47 and 48 on the shell 21. Thereafter, the barrel 20 and the shell 21 are pushed axially toward each other until the bosses 76, 77 and 78 on the coupling nut are positioned axially behind the plane of the radial cams on the shell. The coupling nut is then rotated in a clockwise direction as viewed in FIG. 2 which causes the bosses 76, 77 and 78 on the nut to move behind the radial cams on the shell 21 and the barrel 20 to be drawn toward the shell 21 by the threaded connection provided between the helical slots on the interior of the coupling nut and the helical projections 45, 63 and 64 on the barrel, thereby causing the socket contact 38 to mate with the pin contact 39. At the same time, the rollers 49, 50 and 51 carried by the coupling nut track the radial cams on the shell 21. As mating approaches completion, the rollers snap into detents provided by the surfaces 72 and 73 on the radial cams providing a tactile and audible indication of coupling completion as well as a locking function.

The audible snap occurs when the radial cam followers pass over edge 71. The tactile indication is provided at the same location and can be felt at the outer surface of the coupling nut.

Some other unique features of the present invention are:

(A) The radial cams provide sustaining torque maintaining a bottomed condition of surfaces 67 and 68.

(B) The circular cam follower spring 54 provides a tactile indication of connection completion.

(C) The metal-to-metal rigid bottoming is achieved by the use of one or more cams without the use of axially acting springs or springing members acting in an axial direction.

What is claimed is:

1. An electrical connector comprising:

a hollow cylindrical shell; a hollow cylindrical barrel, said shell and said barrel having a telescoping connection, said shell and said barrel having a keyed connection to permit axial movement relative to each other, said keyed connection preventing rotational movement relative to each other; first and second insulators fixed inside said shell and said barrel, respectively, said first and second insulators carrying first and second contacts, respectively, one contact being a socket contact, the other contact being a pin contact, said shell and said barrel having abutting end surfaces when said contacts are mated; a coupling nut having a rear portion threaded to said barrel in a manner, when turned in a predetermined direction relative to said barrel and said shell, to cause said end surfaces to be drawn into mutual engagement, and said contact to be mated, said shell and the forward portion of said coupling nut, having engagement means preventing axial movement of said coupling nut and said shell relative to each other in one angular position of said nut relative to said shell and allowing axial disengagment therebetween in a second angular position of said nut relative to said shell; and detent means responsive to rotation of said coupling nut past a point in said predetermined direction for applying a force to said coupling nut in the self-same said predetermined direction.

2. The invention as defined in claim 1, wherein said detent means includes one cam having a first ramp surface and a second ramp surface, said ramp surfaces having different slopes at said point and intersecting at said point, a detent, a spring to bias said detent against said ramp surfaces, said detent means being mounted on and fixed between said coupling nut and said shell.

3. The invention as defined in claim 2, wherein said barrel and said shell have a common axis, and said end surfaces thereof lie in planes perpendicular to said axis 4. The invention as defined in claim 3, wherein said detent means includes two additional cams mounted ±120 degrees from said one cam around said axis, and wherein two additional detents are provided for said two additional cams.

5. The invention as defined in claim 1, wherein said barrel and said shell have a common axis, and said end surfaces thereof lie in planes perpendicular to said axis.

6. An electrical connector comprising:

a hollow cylindrical shell; a hollow cylindrical barrel, said shell and said barrel having a telescoping connection, said shell and said barrel having a keyed connection to permit axial movement relative to each other, said keyed connection preventing rotational movement relative to each other; first and second insulators fixed inside said shell and said barrel, respectively, said first and second insulators carrying first and second contacts, respectively, one contact being a socket contact, the other contact being a pin contact, said shell and said barrel having abutting end surfaces when said contacts are mated; a coupling nut threaded to said barrel in a manner, when turned in a predetermined direction relative to said barrel and said shell, to cause said end surfaces to be drawn into mutual engagment, and said cntacts to be mated, said shell having engagement means to prevent axial movement of said coupling nut and said shell relative to each other while permitting rotation of one relative to the other; and detent means responsive to rotation of said coupling nut past a point in said predetermined direction for applying a force to said coupling nut in the self-same said predetermined direction into mutual engagement and said contacts to be mated; at least one cam fixed to the exterior of said shell, said one cam having first and second circumferential surface portions intersecting at a point; a detent carried by said coupling nut in a position to ride successively on said first and second circumferential surface portions as said coupling nut is rotated in said predetermined direction relative to said shell, said first circumferential surface portion increasing in radius and said circumferential portion becoming progressively closer to the connector center axis in said predetermined direction; and a spring carried by said coupling nut to bias said detent against said cam surfaces.

7. The invention as defined in claim 6, wherein said coupling nut includes a body having projections slidably straddling said cam.

8. The invention as defined in claim 6, wherein said detent is movable around said shell in rolling contact with said cam.

9. The invention as defined in claim 6, wherein two additional cams are fixed relative to said shell ±120 degrees therearound from said one cam, and two additional detents are provided for said two additional cams.

10. The invention as defined in claim 9, wherein said detents are movable around said shell in rolling contact with said cams.

* * * * *